United States Patent [19]

Fröhlich

[11] Patent Number: 5,073,212

[45] Date of Patent: Dec. 17, 1991

[54] METHOD OF SURFACE HARDENING OF TURBINE BLADES AND THE LIKE WITH HIGH ENERGY THERMAL PULSES, AND RESULTING PRODUCT

[75] Inventor: Richard L. Fröhlich, San Jose, Calif.

[73] Assignee: Westinghouse electric Corp., Pittsburgh, Pa.

[21] Appl. No.: 458,930

[22] Filed: Dec. 29, 1989

[51] Int. Cl.[5] ..... C21D 1/06; C21D 10/00; C22C 38/18; C22C 14/00

[52] U.S. Cl. ..... 148/152; 148/133; 148/135; 148/145; 148/146; 148/325; 148/421; 148/903

[58] Field of Search ..... 148/145, 146, 147, 150, 148/152, 133, 135, 903, 325, 327, 421, 133, 135, 325, 327, 145, 146, 147, 150, 152, 421, 903

[56] References Cited

U.S. PATENT DOCUMENTS

| | | | |
|---|---|---|---|
| 3,647,577 | 3/1972 | Gomada et al. | 148/150 |
| 4,147,570 | 4/1979 | Corbo et al. | 148/144 |
| 4,151,014 | 4/1979 | Charschan et al. | 148/13 |
| 4,154,565 | 5/1979 | Hyde et al. | 425/369 |
| 4,239,556 | 12/1980 | Cline et al. | 148/327 |
| 4,303,137 | 12/1981 | Fischer | 175/374 |
| 4,304,978 | 12/1981 | Saunders | 219/121.6 |
| 4,323,401 | 4/1982 | Belke et al. | 148/320 |
| 4,398,966 | 8/1983 | Kelly et al. | 148/135 |
| 4,533,400 | 8/1985 | Benedict | 148/4 |
| 4,617,070 | 10/1986 | Amende et al. | 148/152 |
| 4,708,752 | 11/1984 | Kar | 148/127 |
| 4,772,340 | 9/1988 | Kawaguchi et al. | 148/152 |

*Primary Examiner*—R. Dean
*Assistant Examiner*—Robert R. Koehler
*Attorney, Agent, or Firm*—D. Schron

[57] ABSTRACT

A process for improving the fatigue and stress resistance of transformation hardenable metal turbine blades and other workpieces. The metal is preferably selected from the alloy groups Fe-C, Fe-30%Ni, Fe-12%Cr, and titanium-based alloys. The process includes the step of selectively applying a pulsed heat source to a preselected area of the root of the turbine blade or other preselected area of a workpiece. The step of selectively applying a pulsed heat source is carried out in the absence of carbonaceous material, so that absorption of carbon into the steel does not take place to a significant extent. Controlled pulsing prevents melting of the metal. The process includes the step of inducing a localized martensitic reaction at the preselected area to provide a hardened area having compressive stress. According to one embodiment, the pulsed heat treatment is carried out with an inductive heating element. In another embodiment of the present invention, the pulsed heat treatment is carried out by adding a coupling material to the preselected area in order to enhance light absorption, and directing pulses of a carbon dioxide laser beam onto the preselected area.

3 Claims, 3 Drawing Sheets

FIG. 1
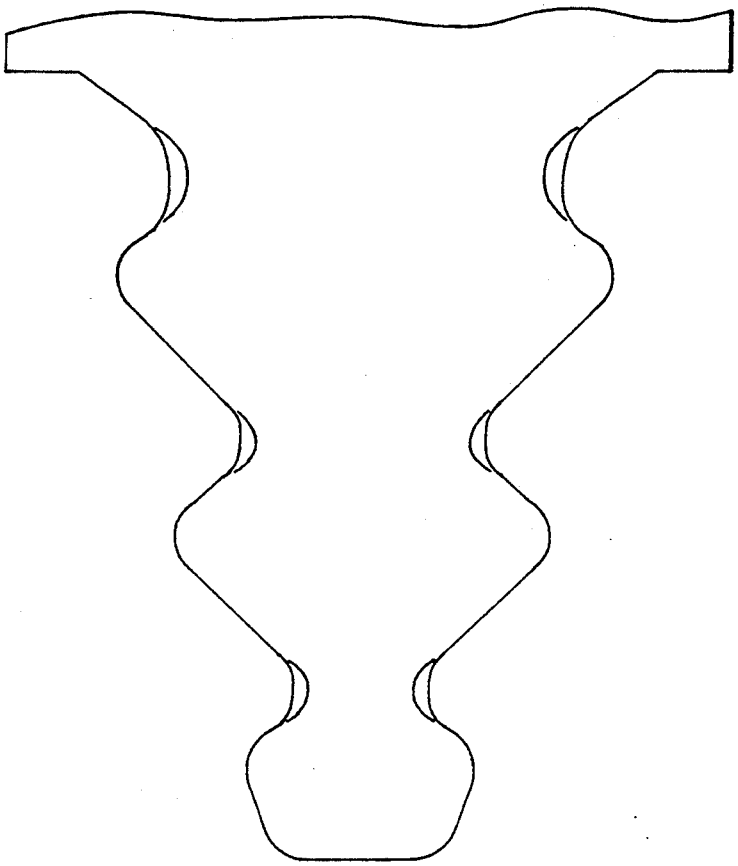
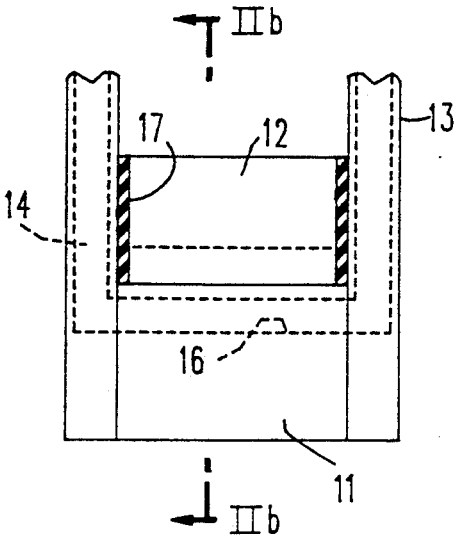
FIG. 2A
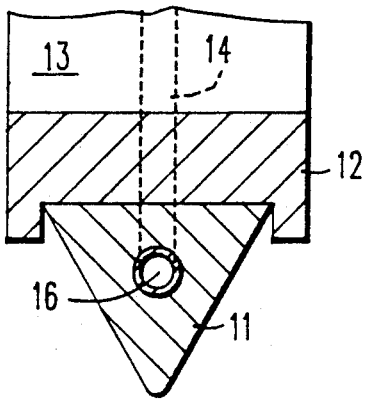
FIG. 2B

METHOD OF SURFACE HARDENING OF TURBINE BLADES AND THE LIKE WITH HIGH ENERGY THERMAL PULSES, AND RESULTING PRODUCT

BACKGROUND OF THE INVENTION

The present invention relates to improving the fatigue and stress resistance of transformation hardenable metal alloy components. More particularly, the invention relates to a process for improving the fatigue resistance cf turbine blades and other components with very high energy pulsed heat treatments.

Turbine blades are typically manufactured from high quality forged and cast alloys using conventional cutting or broaching operations. The performance of turbine blades is integrally related to both the design of the blade and the materials used to manufacture the blade. Turbine blades must withstand centrifugal forces due to the mass of the blade and the rotation of the rotor, bending stresses caused by axial and tangential forces exerted by hot gas or steam, vibrational stresses, and thermal stresses imparted by changes in temperature from ambient to operating temperatures. Many of these stresses concentrate at the blade root. For this reason, the mechanical and material requirements of turbine blades are quite high. Failure of a turbine blade can result in catastrophic loss of equipment, personal injury and potential loss of life.

Improving bending fatigue performance in cyclicly stressed parts often requires costly alternatives such as changing designs, specifying higher quality materials, or less often, specifying processes that can impact residual compressive surface stresses at those locations subject to fatigue failure. Shotpeening or particulate blasting techniques are examples of known processes that can locally induce compressive residual stresses by deforming or cold-working the surface of the part. Furnace hardening processes subject the entire part to unnecessarily high temperatures that can result in dimensional instability or in changes to desirable properties of the material.

A process of improving materials called carburizing is known in which carbon is introduced into the surface layer of a low carbon steel by heating a part in a furnace while it is in contact with a carbonaceous material. The carbon diffuses into the steel from the surface and converts the outer layer into high carbon steel. The part is then removed from the furnace, allowed to cool and heat treated at a temperature above the transformation point and quickly quenched. The high carbon surface layer is then transformed into a hard case containing martensite, while the low carbon core is left tough and shock resistant. The disadvantage of the carburizing process is that the part to be treated requires selective masking. Furthermore, the quenching step introduces distortion into the part, requiring a final grinding operation to correct the distortion. If carburizing were used to harden turbine blades the entire blade would need to be heated causing undesirable variations in the blades dimensions and changes in mechanical properties within the blade.

A process of improving parts by induction hardening is also known. In that prior art process, the part to be hardened is placed inside an induction coil. Rapidly alternating current flows through the coil quickly heating the portions of the part in contact with the coil. The depth of the heating is controlled by the frequency of the current. Conventional induction hardening also requires a quenching step which results in distortion in the treated workpiece. This distortion causes the necessity for final regrinding steps in high quality parts having critical tolerances.

Industrial lasers have been used to selectively harden portions of parts by inducing local martensitic phase transitions. Examples of such processes are found in United States Pat. Nos. 4,323,401, 4,533,400, and 4,617,070.

U.S. Pat. No. 4,304,978 discloses a transformation hardening process in which a laser beam is directed onto the surface of a transformation hardenable material at sufficiently high temperatures to produce an incandescent reaction with the workpiece. At the same time, the dwell time of the laser beam on the work surface is kept sufficiently short so that no significant melting of the workpiece takes place. However, this process has the disadvantage that a jet of cooling gas is required to quench the workpiece and prevent localized melting.

It is therefore an object of the present invention to provide a method for significantly improving the quality and fatigue performance cf turbine blades and other workpieces without treating the entire workpiece.

It is also an object of the present invention to provide a method for improving the fatigue resistance of turbine blades while producing only small local distortion, thus obviating the need for subsequent regrinding.

It is a further object of the present invention to provide a process for improving the fatigue resistance of turbine blades and other parts in nearly finish machined condition.

It is yet another object of the present invention to provide a process which can be adapted to numerous applications where locally superior metallurgical and fatigue resistance properties are desirable in workpieces of all types.

SUMMARY OF THE INVENTION

In accordance with the above objects, the present invention provides a process for improving the fatigue and stress resistance cf transformation hardenable metal turbine blades and other workpieces. The metal is preferably selected from the alloy groups Fe-C, Fe-30%Ni, Fe-12%Cr, and titanium-based alloys. The process according to the present invention comprises the step of pulsing a preselected area of the root of the turbine blade or other preselected areas of an alloy workpiece, with thermal energy. This step is carried out in the absence of an external carbonaceous material, so that absorption of carbon into the steel does not take place to a significant extent. Pulsing can prevent melting of the metal.

The process of the present invention also comprises the steps of localized hardening and compressively stressing the preselected area by an induced martensitic reaction.

According to a preferred embodiment, the metal comprises AISI type 403 stainless steel. AISI 403/410 stainless steels are typical turbine blade alloys. This invention could be adapted to other carbon containing stainless steels, such as higher carbon containing AISI-422 stainless in situations where higher strength and fatigue resistance are desirable, e.g. for rotors.

According to another embodiment, the pulsed heat treatment is carried out with a inductive heating element. The induction heating element preferably has a geometry adapted to permit close magnetic coupling with the preselected area.

In yet another embodiment of the present invention, the process comprises the step of adding a coupling material to the preselected area in order to enhance light absorption, and directing pulses of a laser beam onto the preselected area.

The present invention also includes turbine blades and other workpieces improved according to the process of the present invention.

Further objects, features and advantages of the present invention will become apparent in the description of the preferred embodiments which follows, when considered in connection with the attached figures.

BRIEF DESCRIPTION OF THE DRAWINGS

In the drawings:

FIG. 1 shows a cross section of an improved turbine blade made according to a preferred embodiment of the process of the present invention;

FIGS. 2(A) and 2(B) are side and sectional views of an inductor of a preferred embodiment of the process of the present invention;

DESCRIPTION OF THE PREFERRED EMBODIMENTS

Figure 3:
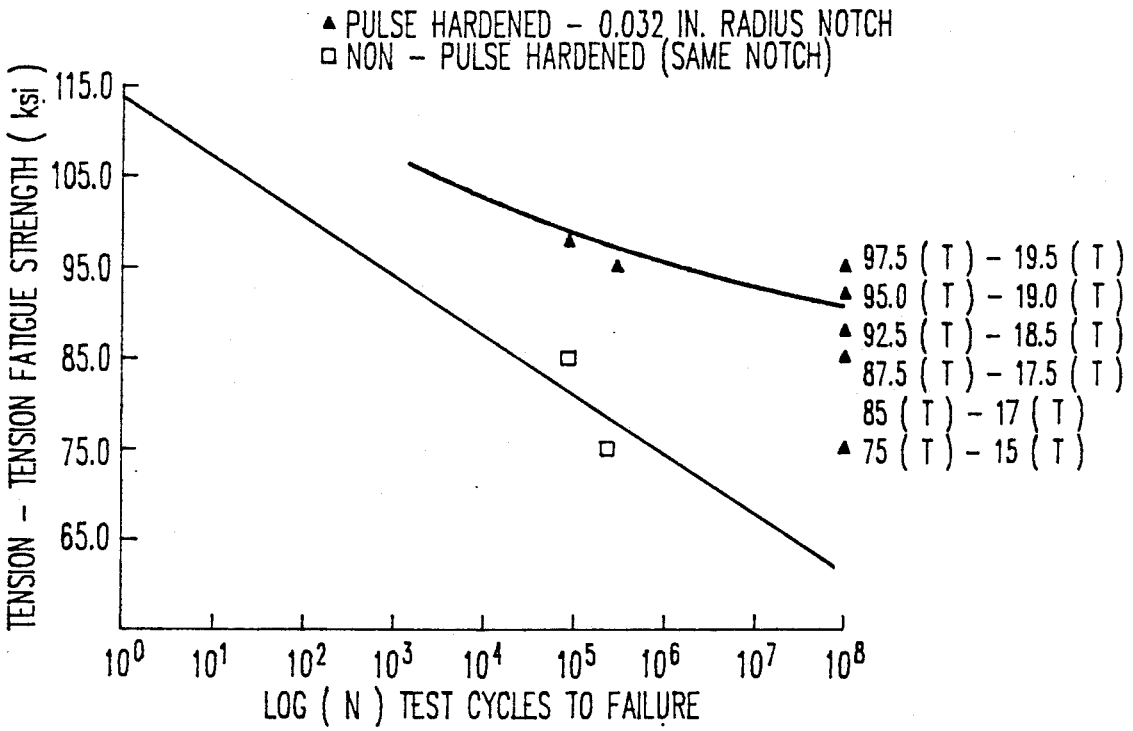
FIG. 3 is a Weibull curve showing the increase in fatigue endurance in type 403 stainless steel rods hardened by a process according to the present invention.

According to the present invention, mechanical strength, fatigue resistance and dimensional stability are increased by locally improving the metallurgical characteristics of the alloy while simultaneously imparting compressive residual stresses in preselected areas most likely to fail. FIG. 1 shows locally high stressed areas 10 of a steam turbine blade which can be treated by the process of the present invention for improved fatigue performance. A tenon protrusion on a blade also can be treated by the process of the invention.

The process of the present invention requires neither costly design nor material changes. The two embodiments of the process of the present invention described herein significantly improve the metallurgical and residual stress condition of Type 403 turbine blade quality stainless steel in small, preselected areas. It does so by providing significantly finer martensitic structures in such areas than are obtained via conventional quenching. The first embodiment utilizes very high frequency, pulsed induction heat treating, and the second embodiment utilizes pulsed laser heat treatment. The general material properties of the part are unaffected by the present process and distortion is within acceptable limits. The process according to the present invention permits tailoring superior material properties onto preselected high stress areas while maintaining overall part tolerances. Significant improvements in fatigue strength result after treatment according to the present process.

This present process requires that the base material of the part to be treated be made of a transformation hardenable alloy. These materials are capable of undergoing martensitic phase transformations, preferably transformations to a fine grained condition. This group of alloys includes both ferrous and non-ferrous metals. Some of the more important alloy groups include Fe-C, Fe-30%Ni, Fe-12%Cr, and titanium-based alloys. Each of these generic alloy groups must have a composition capable of undergoing a martensitic reaction.

Martensitic reactions are diffusionless phase transformations wherein crystal or lattice restructuring occurs with accompanying shear strains. By definition, no composition changes occur with this type of phase transformation, although elements such as carbon can shift into new locations in the lattice resulting in hardening and strengthening of the alloy. The more important alloys of interest exhibit a significant volumetric increase during the heat treatment according to the present invention. This volumetric increase results in a highly compressive residual stress state after processing. According to the present invention, important improvements in strength and fatigue resistance can be obtained on low carbon ferrous and non-ferrous alloys as a result of imparting compressive residual stresses and metallurgical improvements.

The process of the present invention does not work as a result of surface hardening due primarily to an increase in the carbon content of the base metal. It works by inducing a martensitic phase transition in preselected areas of the part or workpiece to be treated. The two most important factors in producing a martensitic phase transition are temperature and thermal gradients. The heat treating process of the present invention must first develop sufficient heat flux to rapidly elevate the surface temperature into a solution treating range, and secondly, the part itself must provide sufficient heat sink properties to rapidly conduct the surface heat away after the heat source is removed. Surface melting is strictly avoided in the process according to the present invention.

Pulsing the heat treating cycle serves two important tasks in the process of the present invention.

First, multiple, short duration pulses cause incremental heating and cooling cycles. This greatly reduces heat buildup in parts as commonly occurs with conventional or non-pulsed surface heat treating processes. Second, the lower total heat buildup provided by pulsing reduces the likelihood of part distortion or base material property changes. Very short pulse durations permit the use of much higher heat fluxes without causing surface overheating or melting. High heat flux cycles assure temporarily high surface temperature followed by rapid cooling, thereby fulfilling the preconditions for a martensitic phase transition.

Two embodiments of the process of the present invention, pulsed induction and pulsed laser heat treating satisfy the energy density requirements needed for transformation hardening of materials by martensitic phase transformation. The pulse induction embodiment is better suited for locally treating small, flat or curved surfaces. The pulsed laser heat treating embodiment, with a broad beam profile, is better suited for treating larger, flatter surfaces because of the tendency for the laser beam to be reflected on curved surfaces.

Induction equipment to heat treat surfaces of transformation hardenable alloys according to the present invention should have the following characteristics: (1) reproduceability; (2) rapid recovery; (3) capability for producing high energy densities; (4) capability for rapid pulsing; (5) a mega-hertz frequency band; and (6) a very low resistance inductor. A powerful, very high frequency, commercially available pulsed induction power supply with the above features has been used to perform experiments on Type 403 martensitic stainless steel.

This was the IMPULSA-II available from Impulsphysik, Hamburg, W. Germany. Product literature issued by Impulsphysik GmbH claims the delivered power is approximately 10kW.

The pulsing feature is critical in the present process since it triggers the transformation hardening during the pulse OFF portion of the heat cycle. Multiple pulses of predetermined times increase the depth of the heat treat pattern. Pulse induction hardening differs from conventional induction hardening primarily in the inductive frequency range (2–3 orders of magnitude higher), energy storage means (capacitor), heat treat cycle wave shape (square), and delivered energy per pulse. The process is limited to heat treating local areas that can be accessed by a precision inductor to concentrate magnetic fields thereby focusing the heat treating energies into the specific area to be treated.

An inductor made from a low resistance material such as high purity silver or copper is a preferred feature of the present process to minimize ohmic losses during the induction heating cycle. The inductor must not be allowed to overheat. It is therefore preferable to utilize cooling techniques such as passing coolants onto or through the inductor. The geometry of the inductor is preferably adapted to permit close magnetic coupling with the desired heat treating surface. In this connection, FIG. 2 shows an inductor geometry designed to provide localized pulsing in the root areas of turbine blades. It includes a triangularly shaped core 11 having a ferrite body 12 closely coupled to the same to focus an electromagnetic field as desired. A pair of copper end plates 13 are provided to connect to the coil (not shown) wrapped on the inductor core 11. Such plates act as leads and each includes a channel 14 for directing cooling water into channel 16 in core 11. As illustrated, insulating sheets 17 separate the focusing body 12 from the plates 13.

While inductor geometry is important to a successful system, the invention is not to be restricted to the geometry of the inductor shown in FIG. 2. Since high conductivity is an important quality of the inductor, the closer one comes to superconductivity, the more efficient one can make an inductor and power leads to the same. Coolants may well have to be run through the inductors for any particular design. Sharp edges should be avoided on non-circular inductors.

Two halt techniques have been used—multiple very short pulses and a single long pulse. The multiple short pulse technique was 0.090 seconds-ON followed by 0.040 seconds-OFF or the burst of 18 pulses. A single long pulse was studied where the pulse time varied between 0.560, 0.580, and 0.600 seconds. The multiple short pulse technique is preferred because there is less chance of heat buildup. However, the base material has an opportunity to dissipate some of the heat during the OFF mode.

Stand-off distance from the inductor to the part is important. Fortunately, turbine blades are manufactured to very exact dimensions, hence variations in joint geometry are virtually non-existent. A stand-off distance of 0.23 millimeters has been used. Increasing the stand-off distance will make the set up of parts easier but will increase the total time to surface treat parts. Acceptable stand-off distances fall within the range of 0.009–0.020 inches.

The pulse induction hardening process develops very high heat flux by discharging a capacitor into switching and oscillating electronic circuitry. During each heating cycle, the main storage capacitor discharged energy through a pair of programmed switching thryatrons to produce a square wave heating cycle of preset duration for both the ON and OFF mode. Subsequently, the square wave pulse passed into a triode oscillation circuit where a 27.12 MHz frequency band was superimposed onto the pulse prior to entering the low resistance output inductor. As with any induction heating system, surface heating occurred by eddy current formation and hysteresis losses (ferromagnetic materials) in a rapidly changing magnetic field. The high energy flux created by the pulse hardening process creates very rapid surface heating with close coupling of the inductor to workpiece. Surface hardening depth of penetration is shallow because frequency is inversely related to penetration as shown in the following fundamental relationship:

$$\delta = 503\sqrt{p/uf}$$

p = specific resistivity
u = magnetic permeability
f = frequency
δ = depth of penetration The output power is governed by the relationship for stored energy in a charged capacitor:

$$Energy = \tfrac{1}{2}cv^2$$

C = capacitance
V = output voltage

Equipment setting can be used to vary heat treat patterns and case depth. Controls include the number of pulses, pulse duration (e.g. time (m-sec.): PULSE ON and PULSE OFF), energy per pulse, and coupling distance between the workpiece and the inductor. Inductor geometry, material chemistry and metallurgical state can also affect heat treat pattern and case depth.

During a typical heating cycle, the high density heat flux is locally concentrated beneath the inductor at the surface and a few mils subsurface. This has important metallurgical benefits. The surface reached an austenitizing temperature (1400° F.–2000° F.) well before the subsurface and core of the part start to heat up, consequently, interior mechanical and metallurgical properties of the material such as tensile strength, toughness, and grain size remain unaffected. The metallurgical changes in the pulse treated zone are significantly different however. After completion of a typical-heat cycle (generally under 1 second) the colder substrate immediately beneath the heat treat zone caused rapid surface cooling and the formation of very fine grain martensite. This reaction caused local surface hardening and the formation of compressive residual stresses in high hardenability alloys. The compressive residual stresses formed on the surface improve fatigue performance when cyclically stressed. The fine grain martensite has improved strength and reportedly, toughness over conventional martensite. Since the process austenitizes local surfaces, minimal part heat up occurred making this technology ideal for modifying surfaces, properties of parts with critical dimensions, thin cross-sectional dimensions or general mechanical or metallurgical properties that must be preserved.

EXAMPLE NO. 1 (PULSED INDUCTION EMBODIMENT)

Experiments have been performed which demonstrate that significant improvements in fatigue strength can be obtained using the process of the present invention. The process operated at a fixed frequency of 27.12 MHz which is typically a $10^2$ to $10^3$ times higher frequency than conventional induction power supplies. Energy to the inductors is delivered in highly repetitive square wave pulses, discharged from a main capacitor bank. The capacitors were selected to have very rapid recovery features to assure that each pulse has a repeatable power level regardless of transient load variations on incoming (line) power.

FIG. 3 summarizes fatigue tests performed on Type 403 stainless steel in a pulse induction treated and untreated state. The Weibull curve of stress vs. cycles to failure shows greater fatigue strength when the fatigue samples were pulse induction treated. The longest running sample in an untreated condition failed at 75ksi after 230,000 cycles. In contrast, pulse treated samples according to the present invention have performed without failure at 100ksi for more than $4.8 \times 10^8$ cycles. Data points on the curve of FIG. 3 show consistently higher fatigue performance on notched specimens heat treated according to the present method than either untreated notched or unnotched rods.

Figure 4:
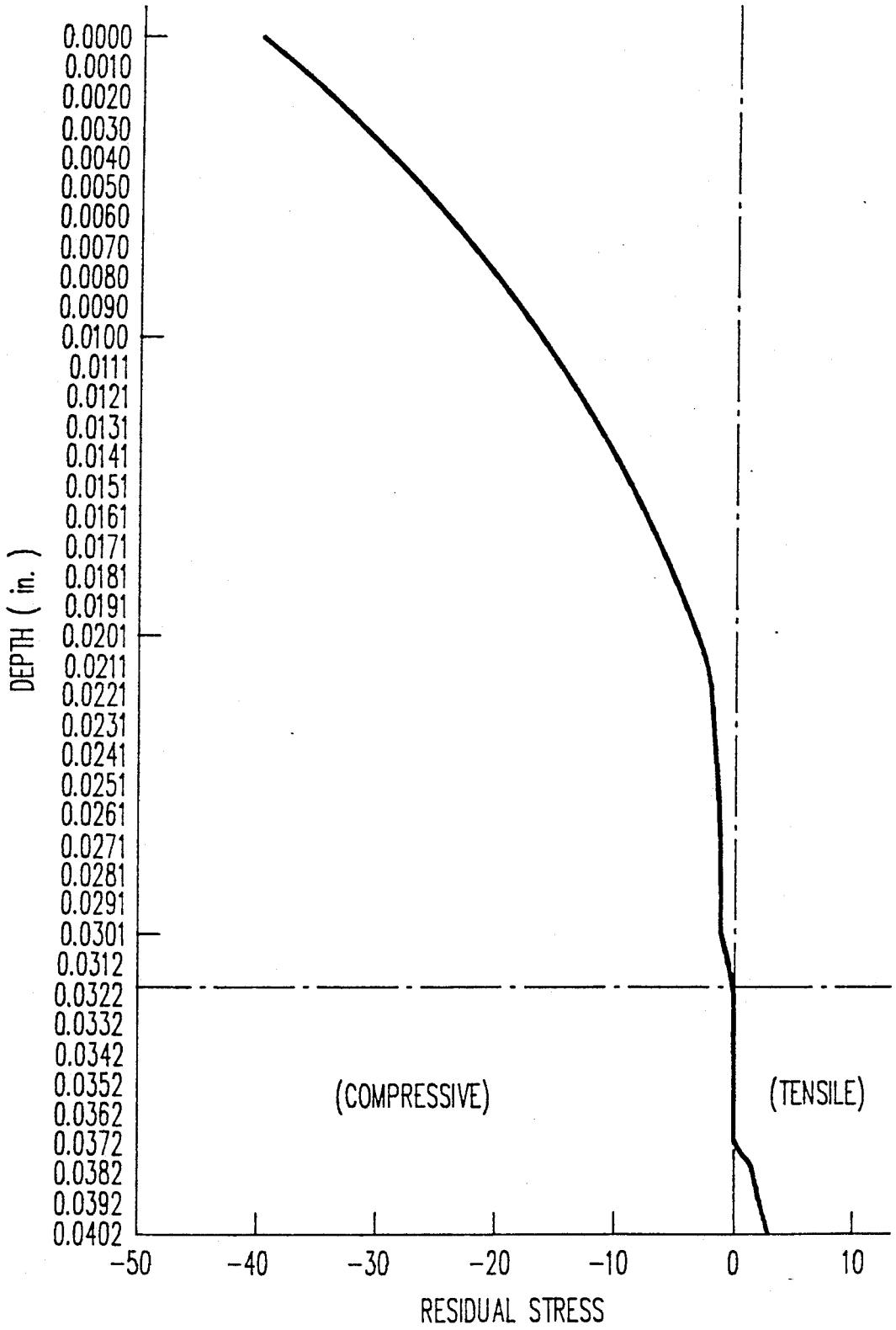
FIG. 4 illustrates the high compressive residual stress value achieved in a shaft treated with a process according to the present invention.

FIG. 4 shows that high compressive residual stress values can be obtained at the surface by using pulsed, very high energy heat treatment according to the present process. It is believed that this high residual stress is due to significantly finer martensitic structures at such surface. FIG. 4 shows a comparison of residual stress vs. depth below the surface on a pulse induction treated shaft according to the present invention. There is a smooth transition from compressive surface stress to subsurface tensile stress evident in the curve.

EXAMPLE NO. 2 (PULSED LASER EMBODIMENT)

Laser experiments have been performed using a high power continuous wave $CO_2$ laser that was rated at 15 kW. A commercially available integrator mirror was used to average the power density of the beam and to shape it to a desirable rectangular shape. A coupling material was added to the surface of the test material to enhance absorption of the 10.6 micron $CO_2$ radiation. Results with type 403 martensitic stainless steel show that metallurgical structures approaching that described with respect to Example No. 1, using the pulse induction embodiment of the present invention could be obtained by locally heat treating with lasers. Preferably, the laser beam was pulsed in a series of ON-OFF cycles. The pulsing step allows increased power density without overheating the surface of the material. The power density and pulsing parameters would be comparable to those used in the first embodiment, the pulsing induction method.

Although the present invention has been described in terms of preferred embodiments, one of ordinary skill in the art will recognize that departures may be made while remaining within the spirit of the present invention. For example, the invention can be used to improve the fatigue and stress resistance of bolts and fasteners at points where bending stresses may occur, e.g., the points where a bolt shank meets a bolt head and has a change of radii for threads. The scope of the present invention is therefore to be determined by the claims and their equivalents.

What is claimed is:

1. A process for improving the fatigue and stress resistance of a workpiece made of a transformation hardenable metal selected from the alloy series groups Fe-C, Fe-30%Ni, Fe-12%Cr, and titanium based, comprising the steps of:

pulsing a preselected area of said workpiece with thermal energy in the substantial absence of carbonaceous material to prevent melting of the metal and absorption of carbon into the same and yet a localized martensitic reaction at said preselected area is caused to provide a hardened area having compressive stress.

2. A turbine blade treated according to the process of claim 1.

3. A workpiece treated according to the process of claim 1.

* * * * *